United States Patent [19]

Lombard et al.

[11] 4,211,991

[45] Jul. 8, 1980

[54] MAGNET-CONTROLLED SWITCH

[75] Inventors: Claude Lombard, Le Chesnay; Guy Viala, Paris, both of France

[73] Assignee: Regie Nationale des Usines Renault, Boulogne-Billancourt, France

[21] Appl. No.: 907,965

[22] Filed: May 22, 1978

[30] Foreign Application Priority Data

May 25, 1977 [FR] France ..... 77 15894

[51] Int. Cl.[2] ..... H01H 9/00

[52] U.S. Cl. ..... 335/207; 200/67 F; 335/153; 335/205

[58] Field of Search ..... 335/153, 205, 206, 207; 200/67 F

[56] References Cited

U.S. PATENT DOCUMENTS

| | | | |
|---|---|---|---|
| 3,175,060 | 3/1965 | Crissinger et al. | 335/205 |
| 3,260,819 | 7/1966 | Scuitto et al. | 200/87 |
| 3,273,091 | 9/1966 | Wales | 200/67 F X |
| 3,283,274 | 11/1966 | De Falco | 335/207 X |
| 3,356,948 | 12/1967 | Zerfass | 335/205 X |
| 3,593,236 | 7/1971 | Beck | 335/207 X |
| 3,663,781 | 5/1972 | Zimmerman et al. | 200/172 R |

FOREIGN PATENT DOCUMENTS

| | | | |
|---|---|---|---|
| 2522870 | 9/1976 | Fed. Rep. of Germany | 335/207 |
| 1420314 | 10/1965 | France | 335/207 |

OTHER PUBLICATIONS

"Neues aus der Technik," Wurzburg May 1968, No. 3, pp. 1 & 2.

Dirks, W. G.; "Keyboard," IBM Technical Disclosure Bulletin; vol. 12, No. 7, Dec. 1969, p. 982.

*Primary Examiner*—Fred L. Braun

*Attorney, Agent, or Firm*—Oblon, Fisher, Spivak, McClelland & Maier

[57] ABSTRACT

Magnet-controlled switch comprising in a case at least one flexible-strip interruptor (FSI) placed between two magnetic plates, one being movable with respect to the other under the action of a manipulatable element, and at least one permanent magnet near each end of the FSI, in such a manner that the magnets exhibit poles of opposite polarities and produce a magnetic field perpendicular to the plates.

10 Claims, 10 Drawing Figures

MAGNET-CONTROLLED SWITCH

BACKGROUND OF THE INVENTION

1. Field of the Invention

The present invention relates to a magnet-controlled switch with momentary contact useful notably in automobiles for turn-signal controls etc.

2. Description of the Prior Art

Magnetic switches have long been known which consist of a surface to be pressed by the operator's finger and magnets acting in cooperation with the said surface on one or more flexible-strip interruptors (FSI's) located in a glass ampule and sensitive to the magnetic field. Under the influence of a large enough magnetic field, the elastic forces of the contact strips are overcome and contact is established at an instant which is difficult to determine with precision, without going to fabrication of FSI's with careful selection, which is counter to economical production.

Such switches are mainly utilized in the form of keys for the introduction of data which, because of their intended use, generally consist of an assembly of buttons offering to the finger a relatively reduced surface, of the order of magnitude of that of a finger tip. The realization of push-buttons and the structure of the switch are quite evidently suited to these dimensions for this particular application.

SUMMARY OF THE INVENTION

Differently, the aim of the present invention is to realize a magnetic switch equipped with one or more flexible-strip interruptors, the push-buttons of which present to the finger a large surface of activation, of the order of several centimeters on a side.

The special technical problems which arise here do not permit the simple transposition of the realization of a small switch to a larger scale.

Thus, the finger must be able to press on any portion of the surface whatever with uniform, smooth and reliable functioning still being assured, the moving elements (notably the permanent magnets) must remain positioned in precise fashion with respect to the fixed elements (notably the FSI's), the force of abrupt release of the switch must at times be adjustable and the FSI's must be protected against undersirable external magnetic influences.

These advantageous results are obtained by the switch of the present invention, the originality of which resides in a special structure, notably in the disposition of the magnets and the FSI('s) inside of a case.

Besides the fact that this arrangement permits the elimination of all mechanical return springs in spite of the large dimensions of the switch, it also permits improvement of the feel, at a cost of fabrication less than if this smoothness of actuation resulted from careful mechanical alignment of the push-button, another possible solution which was not retained.

The invention has then for an object, a magnetic-controlled switch with momentary contact having in a case at least one flexible-strip interruptor (FSI) sensitive to the magnetic field set up by a magnet, one being movable with respect to the other under the action exerted on a manipulation element, characterized by the fact that the FSI is placed parallelly between two plates of soft magnetic material, one fixed, integral with the switch case and the other movable, displaced by the manipulation element, and by the fact that there is provided at least one permanent magnet near each end of the FSI in such a manner that the magnets, attached to one of the plates, give rise in a single plane to poles of opposite polarity and create a magnetic field perpendicular to the plates.

According to other interesting characteristics of the invention, the manipulating element can be a pivoting lever or a push-button much longer than it is wide. In the latter case, it actuates two FSI's placed near the ends of the pushbutton and electrically connected in parallel.

Each FSI can be associated with four permanent magnets disposed near its ends, two magnets placed one on each side at one end and of the same polarity, and two magnets placed one on each side at the other end and of opposite polarity with respect to the first two.

The magnets assure not only the variation of magnetic field suited to actuate the FSI but, in addition, are used to maintain the magnetic plates in position when the switch is at rest. The force of attraction, then, permits a complete and rapid separation of the plates, thus an almost instantaneous actuation of the FSI, and a precise positioning of the active elements while eliminating the need for classical mechanical return springs.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference characters designate the same or similar parts throughout the figures thereof and wherein.

DESCRIPTION OF THE PREFERRED EMBODIMENT

Figure 1:
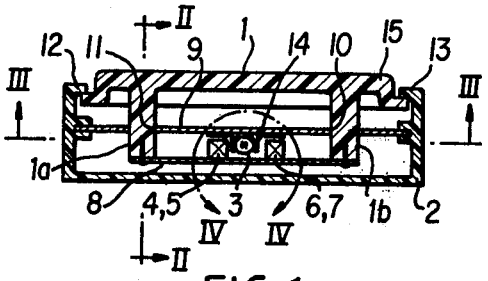
FIG. 1 shows in longitudinal cross section a push-button possessing a single FSI and four magnets.
Figure 2:
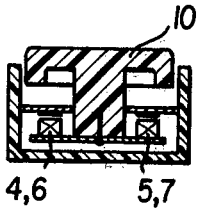
FIG. 2 is a transverse cross section of the switch along the line II of FIG. 1.

Referring to FIGS. 1 and 2, the switch of the invention consists of a case (2), of insulating plastic for instance, and a push-button (1) of the same material able to move into the case when pressure is applied to its control surface on top. The push-button (1) is retained in the case (2) by shoulders (12, 13) coming up against the two inturned upper edges of the case.

A plate (9) of soft magnetic material is held fixed parallel to the bottom of the case (2) between two transverse slotted ribs molded into the case.

A second plate (8) of the same material as the first can be displaced parallely between the first plate (9) and the bottom of the case (2) by pressing on the push-button (1).

To this end, the push-button is prolonged perpendicularly into the interior of the switch by two molded-on feet (1*a*, 1*b*) which pass through two holes (10, 11) of the same size in the fixed plate (9). The movable plate (8) is fastened to the bottoms of the said feet by any suitable means.

A familiar flexible-strip interruptor (FSI) (3), placed in a glass ampule and sensitive to the magnetic field, as well as associated control magnets (4, 5, 6, 7) are disposed between the aforesaid two magnetic plates (8, 9), about in their middle.

Preferably the FSI (3) is made integral with the fixed plate (9) by the intermediary of a cemented trough (14) of nonmagnetic material (FIG. 4), e.g. aluminum, and the low-height permanent magnets (4, 5, 6, 7) are cemented to the movable plate (8) and travel with it.

Figure 3:
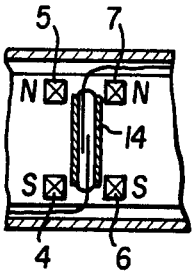
FIG. 3 is a partial cross-sectional view from above of the switch along the line III of FIG. 1.
Figure 4:
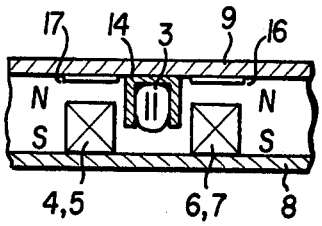
FIG. 4 is an enlarged partial cross-section of the switch within the circle IV.

As is seen more clearly in FIGS. 3 and 4, the FSI, disposed transverse to the case (2), is surrounded by four magnets (4, 5, 6, 7) placed one on each side at its ends.

The magnets ar of high coercive field type, e.g. made of barium or strontium ferrites, or even of rare earths and cobalt.

They are disposed in such a way that, when the movable plate (8) is displaced, the two magnets (4, 6) placed one on each side of one end of the FSI cause the appearance of like poles (e.g. north) while the two magnets (5, 7) placed one on each side of the other end cause the appearance of poles (south) of opposite type.

The FSI (3) is subjected then to an intense leakage magnetic field, even for a slight displacement of the movable plate (8), suited to provoking the establishment of electrical contact between the strips of the FSI.

As the magnetization is perpendicular to the plates (8, 9) these are strongly attracted to one another to return the push-button (1) to its position of rest. In this position the air gap between the magnets and the movable plate (8) is very small or zero, this latter channeling the lines of the field. The magnetic environment of the FSI is then no longer sufficient to actuate it.

Besides the fact that the usual FSI characteristics give a rapid break in contact, the presence of the magnets and their particular disposition permit obtaining notably: —A complete and rapid breakaway of the push-button, the attraction diminishing rapidly as soon as an air gap appears.

Consequently, the FSI is actuated almost instantaneously at the precise instant when the operator starts the push-button moving.

A magnetic return of the push-button to its rest position, which permits, moreover, freedom from the classical return springs.

A precise positioning of the plates in the rest position by magnetic sticking of the magnets to the fixed plate (9).

For a given size of the magnets, the force of magnetic attraction of the plates (8, 9) in the position of rest and thus that of breakaway, can be adjusted by interposition of nonmagnetic shims (16, 17) attached to the fixed plate (9), in the embodiment shown, at right angles to the permanent magnets (4, 5, 6, 7).

As a variant, utilizing more sensitive FSI's, one can eliminate two of the magnets, for instance the magnets 5 and 6 of FIG. 3, keeping only the pair 4 and 7. The functioning remains unchanged, but the displacement of the plates must be greater than with four magnets.

Figure 6:
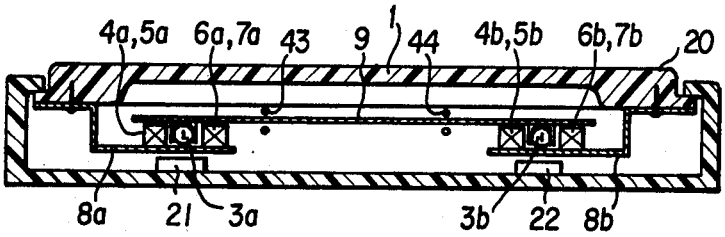
FIG. 6 is a view in longitudinal cross section of a switch of large dimensions possessing two FSI's and four magnets for each FSI.

For the sake of example, the displacements of the push-button (1) necessary for the closure of the contacts of the FSI could be between 0.3 and 2 millimeters, for an FSI with a sensitivity between 8 and 40 ampere-turns. The rest of the travel is arbitrary, but limited nevertheless by pieces of sponge (21, 22) cemented to the bottom of the case (2), as shown in the embodiment of FIG. 6 and intended to give a soft feeling to the operator's finger at the end of travel.

To protect the FSI from the influence of parasitic external magnetic fields, one can either enclose it in a shielding case (2) of magnetic material or place it between two magnetic plates (8, 9). This latter arrangement has been adopted out of preference for its greater simplicity and lower cost.

The push-button (1), continually acted on by the attraction of the magnets on the plates, rests at each long side with a shoulder (12, 13) against a turned in edge of the case (2) about which it can pivot in response to pressure on the push-button anywhere on its surface. The shoulders (12, 13) thus permit obtaining more uniform functioning, even if the posiition of the operator's finger is well off center of the push-button.

Thus, a pressure on the push-button (1), e.g. on the end (15), will make it pivot about the shoulder (12) causing simultaneous unsticking of the magnets (4, 5, 6, 7). It should be noted that in the absence of this shoulder, the button would have pivoted about the magnets 4 and 5, only the magnets 6 and 7 unsticking significantly with the result that the force necessary to start the button (1) moving would be slight and the necessary travel longer since two magnets only would be effective.

Figure 5:
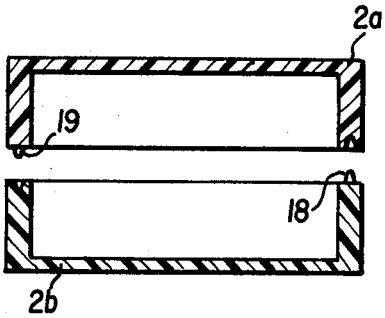
FIG. 5 shows the manner of assembly of the case viewed from above.

A possible mode of assembly is shown in FIG. 5 where the case is composed of two identical half-shells (2*a*, 2*b*) positioned, for instance, by tenons (18) and cemented or fused together. Such an arrangement allows insertion of the internal parts of the switch before putting the shells together, while still maintaining the rigid character of the case (2).

While the realization of the switch as in FIGS. 1 to 5 gives good results with a single central FSI, e.g. for push-buttons up to sixty millimeters long by thirty wide, this structure is no longer suited for all positions of the finger with larger dimension push-buttons.

The realization of FIG. 6 with two FSI's (3*a*, 3*b*) affords a solution satisfactory for buttons of the same width but of a length preferably between sixty and 150 millimeters or more.

The two FSI's (3*a*, 3*b*) are electrically connected in parallel and disposed essentially at right angles to each end of the push-button.

A difference is that the fixed plate (9) does not cover the entire length of the switch and is held between two pairs of crossbars (43, 44) fixed between the long sides of the case (2). The movable plate is made up of two plate elements (8*a*, 8*b*) attached directly to the ends of the push-button on its underside and bent at right angles to pass round the extremities of the fixed plate (9) for a sufficient distance to hold the FSI's (3*a*, 3*b*) and their associated magnets (4, 5, 6, 7, a and b).

The operation is identical to that of the preceding switch. However, a pressure, e.g. on the end (20) of the push-button, will cause a greater displacement of the magnets than if these had been placed in the center of the switch. Moreover, the magnetic positioning of the push-button at rest will be much more satisfactory with this doubled arrangement of FSI's and permanent magnets.

Figure 7:
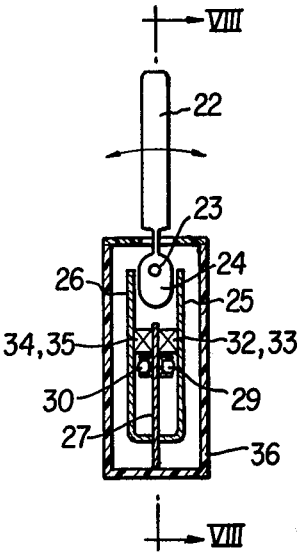
FIG. 7 shows in cross section another realization of the switch of the invention actuated by a pivoting lever.
Figure 8:
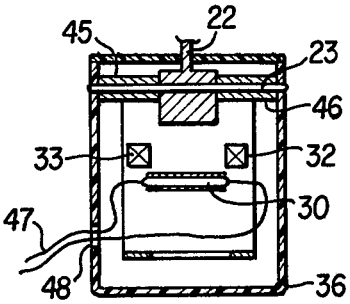
FIG. 8 is a view in cross section of the preceding switch along the line VIII of FIG. 7, and FIGS. 9 and 10, respectively, show a front view of the fixed control plate and a view from below of the movable plates of the switch of FIG. 7.

FIGS. 7 and 8 illustrate another embodiment of a momentary switch conforming to the invention in which the actuation is achieved by the pivoting of a lever (22) placed on end and permitted two distinct commands from a central position of rest.

The switch consists of a central fixed magnetic plate (27) integral with the case (36), and two movable magnetic plates (25, 26), integral with the fixed plate (27), are disposed on one side and the other in defining two air gaps variable by actuation of the manipulating lever (22).

The fixed plate (27) supports two FSI's (29, 30) in opposition, one on each face, two associated permanent magnets (32, 33 and 34, 35), situated on the same side of the FSI, being fixed to each movable plate (25, 26) opposite one another in such a manner that the magnetization is perpendicular to the principal plane of the said plates. Preferably, the magnets will be situated near the lever (22), the displacement of the plates being greater in this case.

The lever acts on the movable plates (25, 26) by the intermediary of a cam (24) pivoting about an axis (23) supported by the side walls of the case (36). The cam is centered on the axis by two crossbars (45, 46) (FIG. 8).

Figure 9:
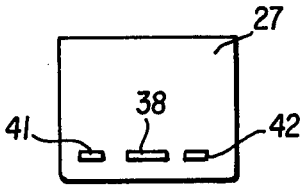
Figure 10:
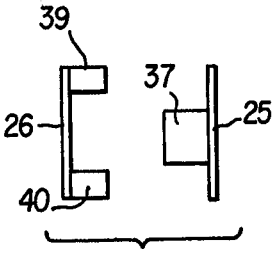

FIGS. 9 and 10 show the assembly of the movable plates (25, 26) to the fixed plate (27). To this end the movable plate (25) has a central foot (37) bent at right angles intended to fit into the corresponding slot (38) in the fixed plate (27). Similarly, the movable plate (26) has two end feet (39, 40) passing through the slots (41, 42) in the fixed plate (27).

The operation of the pivoting switch is identical in principle to that of the preceding push-buttons, with a supplementary choice of the contact to establish.

For clarity in the figures, the electrical output leads of the FSI have not been shown except in FIG. 8 where they are indicated by 47. It suffices to provide an output orifice such as 48 in the switch case, it does not matter where.

The invention is not limited to the embodiments described. Thus, in particular, it would be possible to reverse the relative positions of the FSI and the magnets, i.e. to locate the FSI's on the movable plate and the magnets, on the fixed plate.

Similarly, the it is also possible to fix the FSI's and the magnets side-by-side on the same plate, provided that the magnetic field created by the appearance of the air gap gives a leakage field sufficient to release the FSI.

Obviously, many modifications and variations of the present invention are possible in light of the above teachings. It is therefore to be understood that within the scope of the appended claims, the invention may be practiced otherwise than as specifically described herein.

We claim:

1. A magnetic controlled switch with momentary contact, said switch comprising:

a case;

at least one flexible strip interruptor in said case;

a first ferromagnetic plate fixed to said case;

a manipulation element movably positioned in said case;

a second ferromagnetic plate in said case and fixed to said manipulation element;

at least one pair of magnets, each of said magnets being fixed to one of said plates and contacting the other of said plates to hold said plates in parallel spaced relation, each said pair of magnets having mutually opposite poles adjacent each said plate thereby creating a magnetic field perpendicular to said plates; and wherein said at least one flexible strip interruptor is fixed to one of said plates between said one of said plates and the other of said plates, each said interruptor being positioned between at least one of said pairs of magnets so that said interruptor is subjected to said magnetic field when said magnets are separated from said other of said plates;

whereby said plates protect said interruptor from extraneous magnetic fields.

2. Switch as in claim 1 wherein said flexible strip interruptors (3) is made integral with the fixed plate (9) and the magnets (4, 5, 6, 7) are made integral with the movable plate (8).

3. Switch as in claim 1 or 8 wherein said flexible strip interruptors (3) is fixed to one of the plates by the intermediary of a trough (14) of nonmagnetic material.

4. Switch as in claim 1 wherein said manipulation element is a push-button (1) comprising a pressure surface parallel to the plates, two feet extending perpendicularly into the interior of the switch (1*a*, 1*b*) and passing through orifices (10, 11) in the fixed plate (9), said feet being fastened to said second plate to displace the second plate (8), the flexible strip interruptors (3) being located substantially in the center of the plates (8, 9).

5. Switch as in the claim 4, wherein said push-button includes two shoulders (12, 13) resting against turned in edges of the case (2), about which it can pivot in response to a force on the button (1) anywhere on its surface.

6. Switch as in claim 1 or 8 wherein each said flexible strip interruptors (3) is associated with for permanent magnets disposed near its ends, two magnets (4, 6) placed one on each side at one end and exhibiting like poles, and two magnets (5, 7) placed one on each side at the other end and exhibiting poles of opposite type of the first. and displacing one or the other of said movable plates (25, 26) with respect to said fixed plate (27).

7. Switch as in claim 1 or 8 wherein the force of magnetic attraction of the plates towards the position of rest is adjustable by the interposition of nonmagnetic shims (16, 17) fixed to the said plates (9, 27) at right angles to the magnets.

8. A magnetic controlled switch with momentary contact, said switch comprising:

a case;

at least two flexible strip interruptors in said case;

a first ferromagnetic plate fixed to said case;

a manipulation element movably positioned in said case;

two second ferromagnetic plates in said case, one fixed to each end of said manipulation element;

at least two pair of magnets, each of said magnets being fixed to one of said first and second ferromagnetic plates and contacting the other of said first and second ferromagnetic plates to hold said plates in parallel spaced relation, each said pairs of magnets having mutually opposite poles adjacent each of said first and second ferromagnetic plates thereby creating a magnetic field perpendicular to said plates; and wherein said at least two flexible strip interruptors are fixed to one of said first and second ferromagnetic plates between said first ferromagnetic plate and second ferromagnetic plate, each of said interruptors being positioned between at least one of said pairs of magnets so that said interruptor is subjected to said magnetic field when said magnets are separated from said other of said plates;

whereby said plates protect said interruptor from extraneous magnetic fields.

9. A magnetic controlled switch with momentary contact, said switch comprising:

a case;

a first ferromagnetic plate fixed to said case;

two second ferromagnetic plates integral with said first plate and extending on either side of said first plate in spaced parallel relationship so as to form a gap on either side of said plate;

a manipulation element movably fixed in said case, said manipulation element being positioned so as to contact and move said second plates whereby said gap may be varied;

at least two pair of magnets, each of said magnets being fixed to one of said first and second plates and contacting the other of said first and second plates to maintain said gap, each said pairs of magnets having mutually opposite poles adjacent said first and second plates thereby creating a magnetic field perpendicular to said plates; and at least two flexible strip interruptors fixed to one of said first and second plates between said first and second plates, each of said interruptors being positioned between at least one of said pairs of magnets so that said interruptors are subjected to said magnetic field when said magnets are separated from said other of said first and second plates;

whereby said plates protect said interruptors from extraneous magnetic fields.

10. Switch as in claim 9, wherein said manipulation element is a lever (22) pivoting about an axis (23) interior to said case (36) and including a cam (24) capable of rotating and displacing one or the other of said movable plates (25, 26) with respect to said fixed plate (27).

* * * * *